US005951715A

United States Patent [19]

Rodrigues et al.

[11] Patent Number: 5,951,715

[45] Date of Patent: Sep. 14, 1999

[54] POLYSACCHARIDE ALDEHYDES AND ACETALS AS PERMANENT PRESS AGENTS FOR TEXTILES

[75] Inventors: Klein A. Rodrigues, Signal Mountain, Tenn.; A. Levent Cimecioglu, Princeton, N.J.; Michael C. Hazelwood, Knoxville, Tenn.

[73] Assignee: National Starch and Chemical Investment Holding Corporation, Wilmington, Del.

[21] Appl. No.: 09/159,936

[22] Filed: Sep. 24, 1998

[51] Int. Cl.[6] ..... D06M 13/127; D06M 13/137

[52] U.S. Cl. ..... 8/116.1; 8/120; 8/115.51; 8/181; 8/188; 8/190; 8/116.4

[58] Field of Search ..... 8/120, 116.1, 115.51, 8/181, 188, 190, 116.4

[56] References Cited

U.S. PATENT DOCUMENTS

| | | | |
|---|---|---|---|
| 2,837,511 | 6/1958 | Mantell | 8/120 |
| 3,260,565 | 7/1966 | Beachem . | |
| 3,561,916 | 2/1971 | Baitinger et al. | 8/120 |
| 3,590,100 | 6/1971 | Weiland . | |
| 3,723,058 | 3/1973 | Reinhardt et al. | 8/182 |
| 3,995,998 | 12/1976 | Rowland et al. | 8/115.6 |
| 4,106,903 | 8/1978 | Langheinrich et al. | 8/188 |
| 4,127,382 | 11/1978 | Perry | 8/181 |
| 4,295,846 | 10/1981 | Petersen et al. | 8/186 |
| 4,300,898 | 11/1981 | North | 8/185 |
| 4,332,586 | 6/1982 | North | 8/186 |
| 4,675,394 | 6/1987 | Solarek et al. | 536/43 |
| 4,703,116 | 10/1987 | Solarek et al. | 536/104 |
| 4,900,324 | 2/1990 | Chance et al. | 8/116.4 |

FOREIGN PATENT DOCUMENTS

| | | |
|---|---|---|
| 689282 | 8/1953 | United Kingdom . |

OTHER PUBLICATIONS

Morrison and Boyd, Organic Chemistry, Fourth Edition, pp. 757–758 (month unknown), 1983.

*Primary Examiner*—Alan Diamond
*Attorney, Agent, or Firm*—John D. Thallemer

[57] ABSTRACT

A method for imparting permanent press properties to a textile containing cellulose fibers. The method involves applying an aqueous solution of a polysaccharide aldehyde and/or acetal at a pH of 1 to 8 to a textile, and heating the textile at a sufficient temperature for a sufficient time to react the polysaccharide aldehyde and/or acetal with the textile wherein water is removed from the textile, to impart permanent press properties to the textile. The method of the present invention provides permanent press properties to textiles treated therewith and increases the resistance of such textiles to future laundering abrasion. Such treated textiles display a significant reduction in wrinkles compared with nontreated textiles. Moreover, the treated textiles have a tactile sensation of feeling soft and retain their smoothness after laundering.

30 Claims, 4 Drawing Sheets

POLYSACCHARIDE ALDEHYDES AND ACETALS AS PERMANENT PRESS AGENTS FOR TEXTILES

FIELD OF THE INVENTION

This invention relates to a method for imparting permanent press properties to a textile. More specifically, the method involves applying an aqueous solution of a polysaccharide aldehyde or acetal to the textile.

BACKGROUND OF THE INVENTION

The use of thermosetting resins or reactants to impart crease resistance and dimensional stability to textile materials is well-known in the art. These materials, known as "aminoplast resins", include the products of the reaction of formaldehyde with such compounds as urea, thiourea, ethylene urea, dihydroxyethylene urea, melamines or the like. A serious drawback to the use of such materials is that they contain free formaldehyde. This is present during the preparation and storage of the finishing agent and its use in treating textiles, on the treated fabric, and on the finished garments. Also, when the fabrics or garments made therefrom are stored under humid conditions, additional free formaldehyde is produced.

The problems associated with the presence of free formaldehyde on treated fabrics are well-known and considerable efforts have been made to produce formaldehyde-free textile fabrics. One solution to the problem has been to employ scavengers for the free formaldehyde. In U.S. Pat. No. 3,590,100 cyclic ethylene urea and propylene urea are disclosed as scavengers. Removal of the formaldehyde by reaction with phthalimide is disclosed in U.S. Pat. No. 3,723,058. U.S. Pat. No. 4,127,382 teaches certain nitrogen-containing heterocyclic compounds as scavengers.

Treating textiles with resin compositions that do not contain or evolve formaldehyde are also known. U.S. Pat. No. 3,260,565 describes finishing agents formed by the reaction of alkyl or aryl ureas or thioureas with glyoxal. U.S. Pat. Nos. 4,332,586 and 4,300,898 describe alkylated glyoxal/cyclic urea condensates as crosslinking agents for textiles. U.S. Pat. No. 4,295,846 describes a finishing agent for textiles which is prepared by reacting urea or symmetrically disubstituted ureas in an aqueous solution with glyoxal. These agents, however, have the disadvantage of having marginal permanent press properties.

Good permanent properties have been achieved by applying an aqueous solution of a (hydroxyalkyl)urea or a β-hydroxyalkyl amide crosslinking agent to a textile which is described in U.S. patent application Ser. No. 09/107,817, filed Jun. 30, 1998.

There continues to be a need for permanent press agents which are formaldehyde-free and environmentally safe. Such permanent press agents should also allow consumers the ability to provide permanent press properties easily and cost-effectively to clothing at home.

SUMMARY OF THE INVENTION

Accordingly, it is an object of the invention to increase the resistance of a textile to laundering abrasion.

It is also an object of the invention to provide permanent press to textiles.

It is another object of the invention to provide permanent press to textiles using a formaldehyde-free crosslinking agent.

It is a further object of the invention to provide a formaldehyde-free crosslinking agent as a finishing agent in the manufacture of textiles.

It is an additional object of the invention to provide an environmentally safe and economical method for applying crease resistant properties to textiles in a convenient manner for consumers at home.

With regard to the foregoing and other objects, the present invention provides a method for imparting permanent press properties to a textile containing cellulose fibers wherein said method comprises applying an aqueous solution of a polysaccharide aldehyde at a pH of from about 1 to about 8 to a textile, and heating the textile at a sufficient temperature for a sufficient time to react the polysaccharide aldehyde with the textile wherein water is removed from the textile, to impart permanent press properties to the textile, wherein the polysaccharide aldehyde has a structure selected from the group consisting of

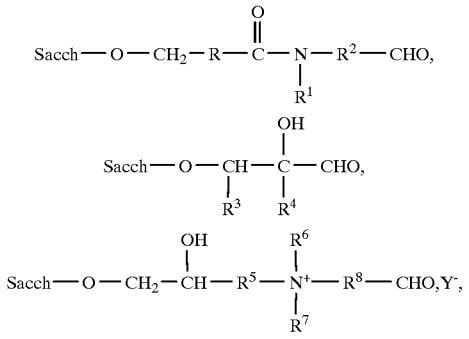

and combinations thereof, wherein Sacch-O is a polysaccharide molecule; R is $(CH_2)_n$ or a divalent aromatic group wherein n is 0 to 22; $R^1$, $R^6$, and $R^7$ are independently selected from the group consisting of hydrogen, and a $C_1$ to $C_{22}$ alkyl, aryl, aralkyl, or alkaryl group; $R^2$, $R^5$ and $R^8$ are independently $(CH_2)_m$ wherein m is 1 to 6; $R^3$ and $R^4$ are independently selected from the group consisting of hydrogen and an alkyl group having 1 to 6 carbon atoms; and Y is an anion.

According to another aspect the invention provides a method for imparting permanent press properties to a textile containing cellulose fibers wherein said method comprises contacting a textile with an aqueous solution comprising a polysaccharide acetal at a pH of from about 1 to about 8, and heating the textile at a sufficient temperature for a sufficient time to hydrolyze the polysaccharide acetal to a polysaccharide aldehyde and to react the polysaccharide aldehyde with the textile wherein water is removed from the textile, to impart permanent press properties to the textile, wherein the polysaccharide acetal has a structure selected from the group consisting of

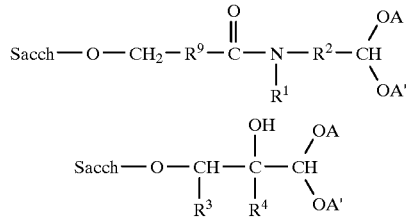

-continued

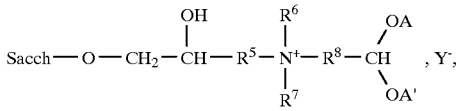

and combinations thereof, wherein Sacch-O is a polysaccharide molecule; R is $(CH_2)_n$ or a divalent aromatic group wherein n is 0 to 22; $R^1$, $R^6$, and $R^7$ are independently selected from the group consisting of hydrogen, and a $C_1$ to $C_{22}$ alkyl, aryl, aralkyl, or alkaryl group; $R^2$, $R^5$ and $R^8$ are independently $(CH_2)_m$ wherein m is 1 to 6; $R^3$ is hydrogen or an alkyl group having 1 to 6 carbon atoms; $R^4$ is selected from the group consisting of hydrogen, and a $C_1$ to $C_{22}$ alkyl, aryl, aralkyl, or alkaryl group; $R^9$ is $(CH_2)_n$ or a divalent aromatic group wherein n is from 0 to about 22; A and A' are independently an alkyl group having 1 to 6 carbon atoms or A and A' together form at least a 5-membered cyclic acetal; and Y is an anion.

According to an additional aspect the invention provides a method for imparting permanent press properties to a textile containing cellulose fibers wherein said method comprises adding an aqueous solution of a polysaccharide aldehyde and/or acetal to a laundering process comprising at least one textile, and heating the textile at a sufficient temperature for a sufficient time to react the polysaccharide aldehyde and/or acetal with the textile wherein water is removed from the textile, to impart permanent press properties to the textile.

The method of the present invention provides permanent press properties to textiles treated therewith and increases the resistance of such textiles to laundering abrasion. Such treated textiles display a significant reduction in wrinkles compared with nontreated textiles. Moreover, the treated textiles have a tactile sensation of feeling soft and retain their smoothness after laundering.

BRIEF DESCRIPTION OF THE DRAWINGS

The above and other features of the invention will be further described in the following detailed specification considered in conjunction with the accompanying drawings in which.

DESCRIPTION OF THE INVENTION

Figure 1:
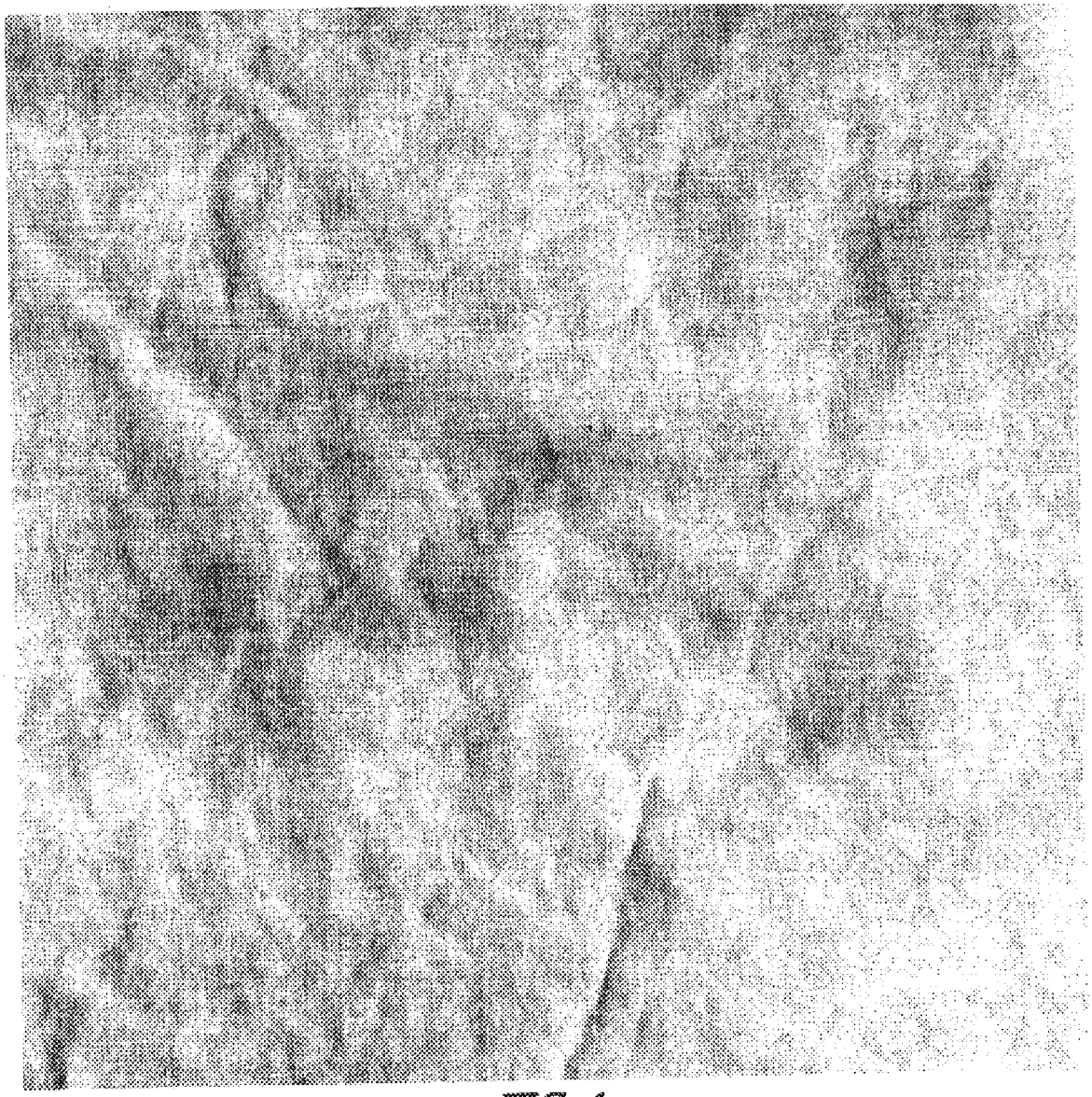
FIG. 1 is a photomicrograph of a white cotton swatch which was treated with an aqueous solution containing a cationic polysaccharide aldehyde according to the invention and washed in a standard washing machine.

This invention relates to a method for imparting permanent press properties to a textile containing cellulose fibers. As used herein, "permanent press" shall be synonymous with wrinkle resistance, durable press, dimensional stability, shrinkage resistance, and wrinkle recovery. The method involves applying an aqueous solution of a polysaccharide aldehyde and/or acetal to a textile, and heating the textile at a sufficient temperature for a sufficient time to react the polysaccharide aldehyde and/or acetal with the textile wherein water is removed from the textile, to impart permanent press properties to the textile. The polysaccharide aldehyde or acetal does not contain formaldehyde and may be applied in the form of an aqueous solution or sprayed.

The polysaccharide aldehyde has a structure selected from the group consisting of

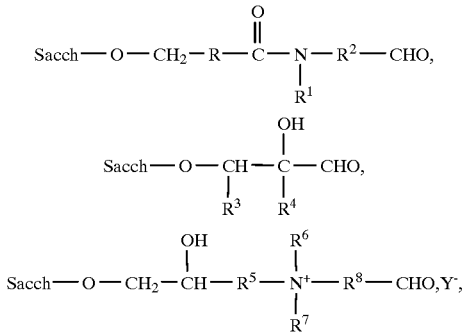

wherein Sacch-O— represents a polysaccharide molecule wherein the hydrogen of a hydroxyl group of a saccharide unit has been replaced as shown; R is $(CH_2)_n$ or a divalent aromatic group wherein n is from 0 to about 22, preferably from 0 to about 11, most preferably from 0 to 5; $R^1$, $R^6$, and $R^7$ are independently selected from the group consisting of hydrogen, and a $C_1$ to $C_{22}$ alkyl, aryl, aralkyl, or alkaryl group, preferably methyl; $R^2$, $R^5$ and $R^8$ are independently $(CH_2)_m$ wherein m is from 1 to 6, preferably 1 to 2; $R^3$ and $R^4$ are independently hydrogen or an alkyl group having 1 to 6 carbon atoms; and Y is an anion such as a halide, sulfate, or nitrate. Combinations of polysaccharide aldehydes can also be used in the method of the invention.

In a preferred embodiment, the polysaccharide aldehyde is cationically modified by the introduction of cationic substituent groups. These cationic substituent groups react with the polysaccharide to form a covalent bond. Typical cationic groups include diethylaminoethylether groups introduced by reaction with 2-diethylaminoethylchloride hydrochloride or 3-(trimethyl ammonium chloride)-2-hydroxypropyl ether groups introduced by reaction with 3-chloro-2-hydroxypropyl trimethylammonium chloride. Such cationic modifications of polysaccharides are well known in the art. Optionally, the polysaccharide aldehydes may be modified by the introduction of anionic, nonionic, amphoteric, and/or zwitterionic substituent groups.

The polysaccharide aldehydes are prepared by hydrolyzing polysaccharide acetals at a pH of from about 1 to about 8, preferably from about 2 to about 6, most preferably from about 2 to about 4. It is understood that any means of adjusting the pH of the aqueous solution may be employed in the method of the invention to achieve a desired pH. U.S. Pat. No. 4,675,394 is hereby incorporated by reference in its entirety for its description and methods of making polysaccharide aldehydes, polysaccharide acetals, and acetal reagents.

The polysaccharide acetal has a structure selected from the group consisting of

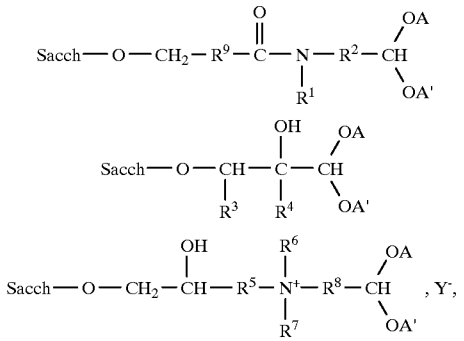

wherein, Saach-O—, R, $R^1$, $R^2$, $R^3$, $R^4$, $R^5$, $R^6$, $R^7$, $R^8$, and Y are defined as above; $R^9$ is $(CH_2)_n$ or a divalent aromatic group wherein n is from 0 to about 22, preferably from 0 to about 11, most preferably from 0 to 5; and A and A' are independently an alkyl group having 1 to 6 carbon atoms or A and A' together form at least a 5-membered cyclic acetal. Combinations of polysaccharide acetals may be used to prepare the polysaccharide aldehydes of the invention.

The polysaccharide acetals are prepared by reacting a polysaccharide, at a pH of about 9 or above, with an acetal reagent which does not substantially crosslink or oxidize the polysaccharide during the reaction. It is understood that any means of adjusting the pH of the aqueous solution may be employed in the method of the invention to achieve a desired pH.

The acetal reagent has the general structure

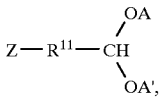

wherein Z is an organic group capable of reacting with the polysaccharide molecule to form an ether derivative, and Z is selected from the group consisting of an epoxide, a halohydrin, an ethylenically unsaturated group, and a halogen; and $R^{11}$ is a divalent organic group containing no reactive substituent.

Typical acetal reagents have the formula

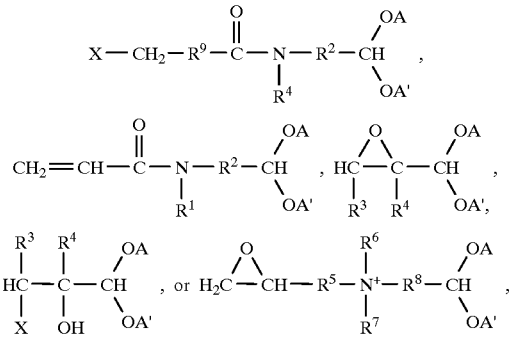

wherein R, $R^1$, $R^2$, $R^3$, $R^4$, $R^5$, $R^6$, $R^7$, $R^8$, $R^9$, A and A' are defined as above; and X is selected from the group consisting of chlorine, bromine, and iodine. In the halohydrin reagent the halogen and hydroxyl groups may be interchanged.

Suitable polysaccharides which are used to prepare the polysaccharide aldehydes or acetals include starch, gum, and cellulose. A combination of polysaccharides may also be used. When the polysaccharide is starch, applicable starch bases may be derived from any plant source including corn, potato, sweet potato, wheat, rice, sago, tapioca, waxy maize, sorghum, high amylose corn, or the like. Starch flours may also be used as a starch source. Also included are the conversion products derived from any of the former bases including, for example, dextrins prepared by the hydrolytic action of acid and/or heat; oxidized starches prepared by treatment with oxidants such as sodium hypochlorite; fluidity or thin-boiling starches prepared by enzyme conversion or mild acid hydrolysis; and derivatized and crosslinked starches. The starch base may be a granular starch or a gelatinized starch, i.e., non-granular starch.

When the polysaccharide is gum, applicable bases which may be used herein are polygalactomannans, which are heteropolysacchrides composed principally of long chains of 1 arrow right 4 beta -D-mannopyranosyl units to which single unit side chains of alpha -D-galactopyranosyl units are joined by 1 arrow right 6 linkages and hereafter referred to as "gums". Also included are degraded gum products resulting from the hydrolytic action of acid, heat, shear, and/or enzyme; oxidized gums; and derivatized gums. The preferred gums include gum arabic, as well as guar gum and locust bean gum because of their commercial availability.

When the polysaccharide is cellulose, cellulose and cellulose derivatives may be used, especially water-soluble cellulose ethers such as alkyl and hydroxyalkylcelluloses, specifically methylcellulose, hydroxypropylmethyl cellulose, hydroxybutylmethylcellulose, hydroxyethylmethyl cellulose, and ethylhydroxyethylcellulose.

In addition to preparing the above acetals or aldehydes, modified derivatives may be prepared which contain other substituent groups, hydroxyalkyl groups (e.g., hydroxypropyl ether groups), carboxyalkyl ether groups (e.g., carboxymethyl), ester groups (e.g., acetate groups), tertiary amino groups (e.g., diethylaminoethyl ether groups), and quaternary amine groups, (e.g., 3-(trimethylammonium chloride)2-hydroxypropyl groups or 4-(trimethylammonium chloride)2-butenyl groups), introduced prior to or subsequent to reaction with the acetal derivatizing reagent or introduced simultaneously by reaction with the acetal reagent and other derivatizing reagent.

The polysaccharide aldehydes and acetals of the invention are applied to textiles in the form of an aqueous solution. The textiles may be woven or non-woven fabrics and include 100% cellulosic fabrics, for example, cotton, rayon, and linen, as well as blends, for example, polyester/cotton or polyester/rayon. Such blends preferably contain at least 20% of cellulose. Both white and colored (printed, dyed, yarn-dyed, cross-dyed, etc.) fabrics can be effectively treated with the polysaccharide aldehyde and/or acetal of this invention. The textiles may comprise new or used clothing including previously worn clothing and/or laundered clothing. Preferably, the cellulosic textiles contain free hydroxyl groups.

Optionally, the method of the invention includes a catalyst to speed up the reaction between the polysaccharide aldehyde and/or acetal and textile. However, the reaction between the polysaccharide aldehyde and/or acetal and textile does not require a catalyst. A catalyst also increases the degree of crosslinking in the reaction between the polysaccharide aldehyde and/or acetal and textile. While not wishing to be bound by any theory, the catalyst decreases the zeta potential or the amount of negative charge on the textile surface and thus increases the amount of crosslinker which is deposited on the textile or fabric from the aqueous solution. It is noted in the examples that follow that aluminum potassium sulfate catalyst is more effective at lower concentrations than magnesium chloride catalyst because the $Al^{+3}$ ion is more positive (higher valency) than the $Mg^{+2}$ ion. The higher valency catalyst is more effective at reducing the zeta potential of the textile, thus increasing the amount of crosslinker deposited on the textile from an aqueous solution. Any substance that can accept an electron pair from a base can be used as a catalyst.

Preferably, the catalyst is a Lewis acid catalyst selected from dibutyltindilaurate, iron(III)chloride, scandium(III) trifluoromethanesulfonic acid, boron trifluoride, tin(IV) chloride, $Al_2(SO_4)_3xH_2O$, $MgCl_2.6H_2O$, $AlK(SO_4)_2.10H_2O$, and Lewis acids having the formula $MX_n$ wherein M is a metal, X is a halogen atom or an inorganic radical, and n is an integer of from 1 to 4, such as $BX_3$, $AlX_3$, $FeX_3$, $GaX_3$, $SbX_3$, $SnX_4$, $AsX_5$, $ZnX_2$, and $HgX_2$. More preferably, the Lewis acid catalyst is selected from $Al_2(SO_4)_3xH_2O$, $MgCl_2.6H_2O$, $AlK(SO_4)_2.10H_2O$. A combination of catalysts can also be used in the method of the invention.

Any method of applying the polysaccharide aldehyde or acetal to the textile is acceptable. Preferably, the textile is impregnated with an aqueous solution of the polysaccharide aldehyde or acetal. As used herein, "impregnate" refers to the penetration of the solution into the fiber matrix of the textile, and to the distribution of the solution in a preferably substantially uniform manner into and through the interstices in the textile. The solution therefore preferably envelopes, surrounds, and/or impregnates individual fibers substantially through the thickness of the textile as opposed to only forming a surface coating on the textile.

In a preferred embodiment of the invention, the aqueous solution of the polysaccharide aldehyde or acetal is applied to the textile in a textile manufacturing process as part of the durable press finishing operation.

In a another preferred embodiment, where the textile is not treated in a textile manufacturing process, the polysaccharide aldehyde or acetal is applied in a laundering process, most preferably to rinse water in the rinse cycle of the laundering process at home or at a laundromat.

In a further preferred embodiment, the polysaccharide aldehyde or acetal is applied by soaking the textile in an aqueous solution containing the polysaccharide aldehyde or acetal.

The treated textile is cured at the normal temperatures provided by either a drying unit used in a textile manufacturing process such as a steam heated drying cylinder, an oven, or an iron. Drying temperatures generally range from about 90° C. to about 300° C. Such temperatures permit water to be removed, thereby inducing crosslinking, for example, by means of acetal linkages, of the polysaccharide aldehyde with the textile.

The residence time of the textile in the dryer unit, oven, or in contact with an iron ranges from about 1 second to about 200 seconds, depending on the temperature. The actual residence time for a particular textile sample depends on the temperature, pressure, type of fabric, and the type and amount of catalyst. Preferably, the time and temperature required to cure the polysaccharide aldehyde and/or acetal with the textile ranges from about 2 to about 60 seconds at a textile temperature ranging from about 100° C. to about 250° C. After the textile with the solution of the polysaccharide aldehyde and/or acetal applied thereto is dried/cured, subsequent coatings or additives may be applied.

In a preferred embodiment, a textile treated with the polysaccharide aldehyde and/or acetal is ironed both on the inside and outside surfaces to maximize the amount of crosslinking and thus permanent press properties of the textile.

Preferred means of applying the aqueous solution of the polysaccharide aldehyde and/or acetal on a textile manufacturing machine are by puddle press, size press, blade coater, speedsizer, spray applicator, curtain coater and water box. Preferred size press configurations include a flooded nip size press and a metering blade size press.

Preferred means of applying the aqueous solution of the polysaccharide aldehyde or acetal on off-machine coating equipment in a textile manufacturing process are by rod, gravure roll and air knife. The solution may also be sprayed directly onto the textile or onto rollers which transfer the solution to the textile. In an especially preferred embodiment of the invention, impregnation of the textile with the aqueous solution of the polysaccharide aldehyde and/or acetal occurs by means of a puddle size press.

Preferred means of applying the aqueous solution of the polysaccharide aldehyde and/or acetal in a laundering process are by adding the solution to the rinse water during the rinse cycle in the laundering process. In an especially preferred embodiment of the invention, impregnation of the textile with the aqueous solution of the polysaccharide aldehyde and/or acetal occurs during the final rinse cycle in a laundering process. In an additional especially preferred embodiment of the invention, impregnation of the textile with the aqueous solution of the polysaccharide aldehyde and/or acetal occurs in a washing machine which contains at least one textile, the polysaccharide aldehyde and/or acetal and optionally a catalyst, wherein the washing machine is not operating so that the textile remains in contact with the treatment solution for a period of time to facilitate the impregnation of the treatment solution into the textiles. The washing machine is turned on to the spin cycle, the textiles are removed, dried and ironed.

Another preferred means of applying the aqueous solution of the polysaccharide aldehyde and/or acetal to a textile such as clothing is spraying by means of a pump or aerosol a solution of the polysaccharide aldehyde and/or acetal onto the textile and then ironing the textile.

The concentration of the polysaccharide aldehyde and/or acetal in the aqueous solution is sufficient to provide from about 0.1 to about 10 weight percent of polysaccharide aldehyde in the textile based on the oven-dry weight of the textile. Preferably, the concentration of the polysaccharide aldehyde and/or acetal in the aqueous solution is sufficient to provide from about 1 to about 5 weight percent, more preferably from about 2 to about 4 weight percent of polysaccharide aldehyde in the textile based on the oven-dry weight of the textile.

The method of the present invention provides permanent press properties to textiles treated therewith and increases the resistance of such textiles to future laundering abrasion. Such treated textiles display a significant reduction in wrinkles compared with nontreated textiles. Moreover, the treated textiles have a tactile sensation of feeling soft and retain their smoothness even laundering.

The following nonlimiting examples illustrate further aspects of the invention.

EXAMPLE 1

Preparation of Acetal Reagent

N-(2,2-Dimethoxyethyl)-N-methyl-2-chloracetamide, which has the formula

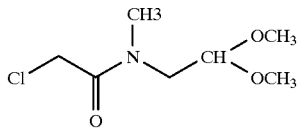

is prepared by adding chloroacetyl chloride (29.05 g) dropwise to a stirred mixture of methylaminoacetaldehyde dimethyl acetal (33.5 g) in toluene (170 ml) and 20% aqueous sodium hydroxide (52.9 g). The reaction was cooled by immersion in an ice/brine bath and the addition rate was adjusted to maintain the reaction temperature at 0° to 5° C. The total addition took 10 minutes at which time the cooling bath was removed. Agitation was continued for an additional 10 minutes and the phases were then separated. Excess toluene was removed from the upper organic phase by distillation at the aspirator to form the acetal reagent which appeared as a brown liquid.

EXAMPLE 2

Preparation of Cationic Starch Acetal by a Consecutive Reaction using Cationic Reagent followed by the Acetal Reagent A native starch or a water fluidity (40 to 80 WF) waxy maize starch (5000 grams) was slurried in 7500 ml of water containing 2000 grams of sodium sulfate. To this mixture was added 361.5 grams of a 65% aqueous solution of 3-chloro-2-hydroxypropyl trimethylammonium chloride and 404.8 grams of a 21% sodium hydroxide solution simultaneously via mixing through an in line mixer. The reaction was maintained at 40° C. to 45° C. for 16 hours. A small aliquat of the reaction mixture (150 ml) was removed and analyzed to contain 0.35% cationic nitrogen.

The pH of the reaction was adjusted to 11 to 11.5, if necessary by adding 4.5% sodium hydroxide solution containing 10% sodium sulfate. The acetal reagent prepared in Example 1, 464.4 grams (as 95.6% active) was added and the slurry was stirred at 40° C. to 45° C. for 16 hours. The pH of the mixture was maintained between 11 and 11.5 by perodic additions of the sodium hydroxidelsodium sulfate solution. The pH of the mixture was reduced to 8 to 9 using 10% HCL. The product was filtered off, washed extensively with water. The pH was adjusted to 8 to 9, and dried. The product was determined to have a total nitrogen content of 0.78% and a nitrogen content due to starch bound acetal reagent of 0.43%.

EXAMPLE 3

Simultaneous Reaction

An unmodified waxy maize starch was slurried in water and 3.15% 2-diethylaminoethylchloride hydrochloride (DEC) and 12% of the acetal reagent prepared in Example 1 were added while maintaining the pH above 11 with a 4.5% NaOH solution. The reaction mixture was maintained at 45° C. and pH 11 to 11.5 for 16 hours and then neutralized to pH 7.5. The product was recovered by the procedure according to Example 2 and was determined to have a total nitrogen content of 0.77%.

EXAMPLE 4

Consecutive Reaction using Acetal Reagent followed by Cationic Reagent

An unmodified waxy maize starch (1000 g) was slurried in 1500 cc water containing 400 g $Na_2SO_4$ and the pH was raised to 11.2 with a NaOH solution made by dissolving 40 g of solid NaOH and 90 g $Na_2SO_4$ in 770 g water. The acetal reagent prepared in Example 1 (10%) was added and the reaction was maintained at pH 11.2 and 45° C. for 16 hours. The product was recovered by the procedure according to Example 2 and was determined to have an acetal nitrogen content of 0.57%.

The resulting starch acetal (200 g) was reacted with 16 g of a 50% queous DEC solution. The final product was determined to contain 0.72% total nitrogen.

EXAMPLE 5

Preparation of Aqueous Solution of Polysaccharide Aldehydes

The polysaccharide acetals prepared in Examples 2, 3 and 4 were converted to the corresponding aldehydes by slurrying the acetal in water (e.g., 100 parts of water/1 part of polysaccharide) and adjusting the pH to 2 to 3 with a dilute solution of sulfuric acid. The polysaccharide acetals were cooked in a boiling water bath, prior to, after, or during the acidification to gelatinize the polysacchande. The total cooking time was about 20 minutes. The slurry was stirred during the acid addition and/or initial cooking. The resulting dispersion of the polysaccharide aldehyde was cooled rapidly.

EXAMPLE 6

Preparation of Aqueous Solution of Polysaccharide Acetals

The polysaccharide acetals prepared in Examples 2, 3 and 4 were slurried in water (e.g., 100 parts of water/1 part of polysaccharide) and the pH was adjusted to 7 to 8 with a dilute solution of sulfuric acid or sodium hydroxide as required. The polysaccharide acetals were cooked gelatinize the per bath to gelatinize the polysaccharide. The total cooking time was about 20 minutes. The slurry was stirred during the initial cooking. The resulting dispersion of the polysaccharide acetal was cooled rapidly.

EXAMPLE 7

Evaluation of the Cationic Polysaccharide Aldehydes Prepared in Example 5 as Permanent Press Agents Cotton swatches, 12"×12" were prewashed three times to remove any mill finishes. The cotton swatches were soaked for 15 minutes in an 10 aqueous solution containing 2% aluminum potassium sulfate ($AlK(SO_4)_2.12H_2O$ and between 0.4% and 0.015%. (0.125%) of the cationic polysaccharide acetal prepared in Example 2. The pH of the solution was determined to be 3.0. A control swatch was presoaked with water without the cationic polysaccharide aldehyde or catalyst. The swatches were removed from the solution and air dried by hanging on a line. The swatches were ironed on both sides at high heat.

The swatches were washed in a washing machine under the following wash conditions: 60 ppm hardness water, 25° C., 0.9 g/l AATCC standard detergent, 10 minute wash, 3 minute rinse. The swatches were dried in a commercial clothes dryer using the "whites and colors" setting for 20 minutes using three towels as ballast. The swatches were laid on a flat surface and the major folds were removed, but no attempt was made to stretch the fabric. The swatches were evaluated for wrinkles on a subjective scale of 1 to 5 wherein 1 signifies a majority of wrinkles and 5 signifies very few wrinkles. The test results are summarized in Table I.

TABLE I

| Example # | Cationic Polysaccharide Aldehyde (Conc. Wt. %) | Visual Rating |
|---|---|---|
| Control | NONE | 1 |
| Ex. 5 | 0.06 | 3 |
| Ex. 5 | 0.03 | 2 |
| Ex. 5 | 0.015 | 2 |
| Ex. 5 | 0.125 | 5 |
| Ex. 5 | 0.4 | 4 |
| Ex. 5 | 0.25 | 4 |

The test results in Table I show that the cotton swatches soaked in an aqueous solution containing 2% aluminum potassium sulfate ($AlK(SO_4)_2.12H_2O$ and between 0.125% of the cationic polysaccharide aldehyde prepared in Example 5 exhibited very few wrinkles as compared to the cationic polysaccharide aldehyde at higher and lower concentrations.

Referring to the drawings, FIG. 1 is a photomicrograph of the white cotton swatch which was treated with 0.125% of the aqueous solution containing a cationic polysaccharide aldehyde prepared in Example 5 and washed in a standard washing machine.

Figure 2:
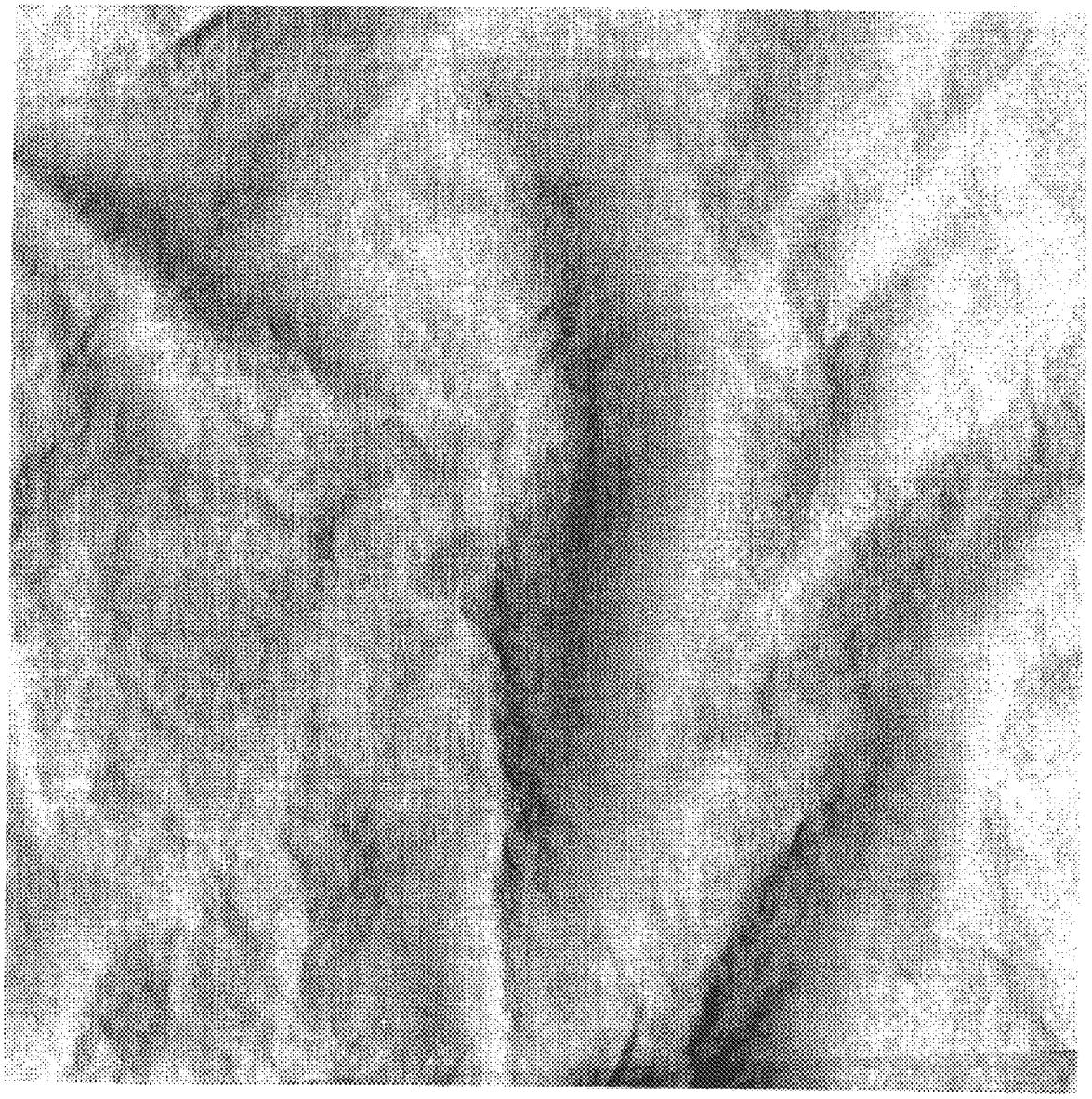
FIG. 2 is a photomicrograph of a white cotton swatch which was not treated with a polysaccharide aldehyde and washed in a standard washing machine.

Referring to the drawings, FIG. 2 is a photomicrograph of a white cotton swatch (Control) which was not treated with the polysaccharide aldehyde and washed in a standard washing machine.

EXAMPLE 8

Evaluation of the Cationic Polysaccharide Acetals Prepared in Example 6 as Permanent Press Agents A $1ft^2$ swatch of 100% cotton (Cotton Club: prewashed to remove sizing) was treated with a 0.125% solution of the cationic polysaccharide acetal prepared in Example 6. The swatch was soaked in the solution for 10 min. The swatch was then soaked for 10 min. in a 2% $AlK(SO_4)_2$ solution while laying flat in order to lower the pH. The pH of the solution was determined to be 3.0. The swatch was then ironed at high heat until dry to facilitate a crosslinking reaction.

An untreated swatch (Control) was prepared with deionized water in place of the polysaccharide acetal solution. The blank and the test swatch were washed in a Maytag commercial washing machine which was set on its "whites" setting. The detergent was an AATCC standard reference at a level of 0.9 g/L. The blank and the test swatch were then dried in a Maytag commercial dryer set on its "whites" setting for 20 min. Three ballast towels were used in the drying step. This is to prevent the swatches from being held on the dryer exhaust vent. After drying the swatches were laid on a flat surface for evaluation. The major folds were removed however the swatches were not stretched.

Figure 3:
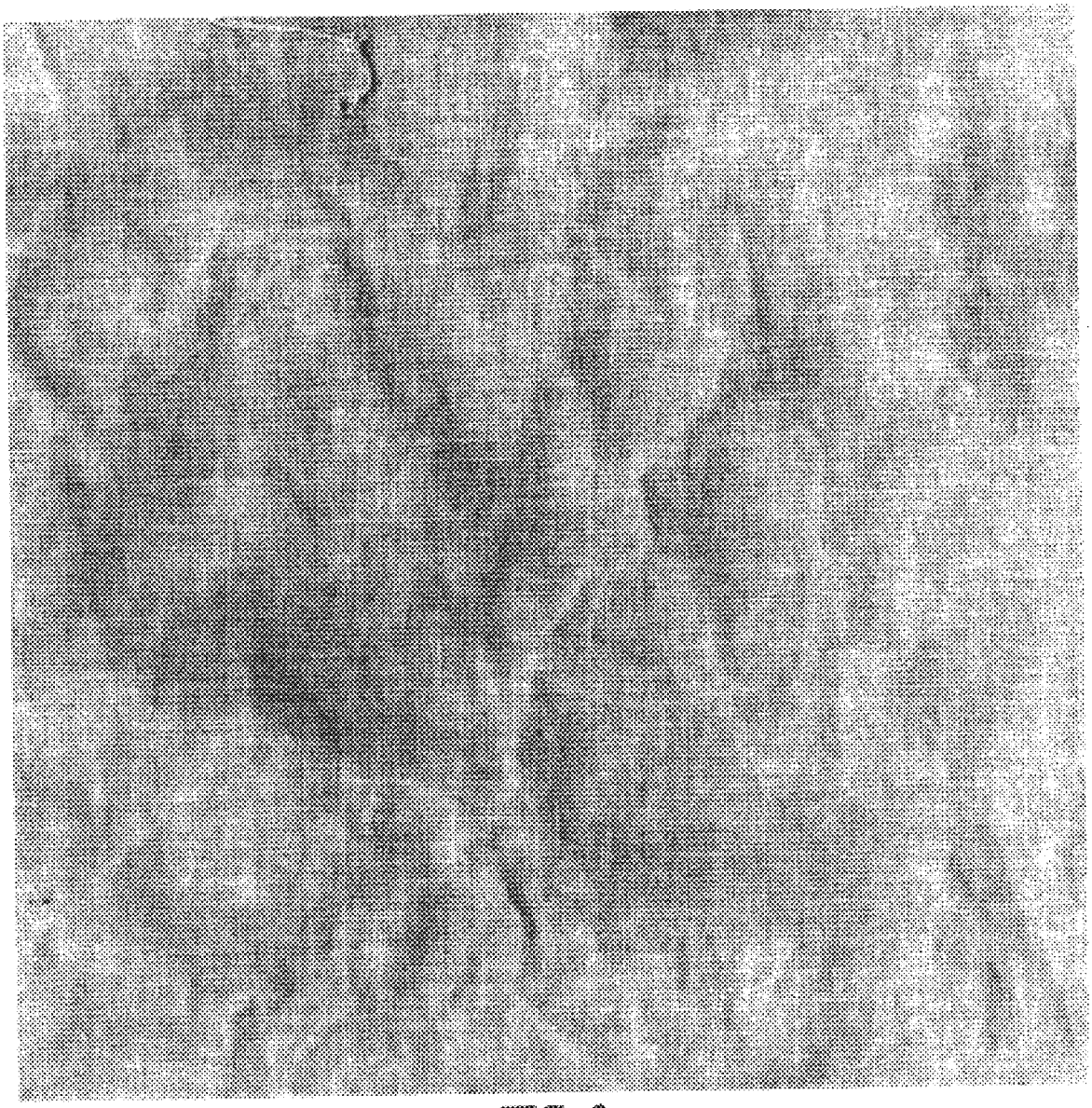
FIG. 3 is a photomicrograph of a white cotton swatch which was treated with an aqueous solution containing a cationic polysaccharide acetal according to the invention and washed in a standard washing machine.
Figure 4:
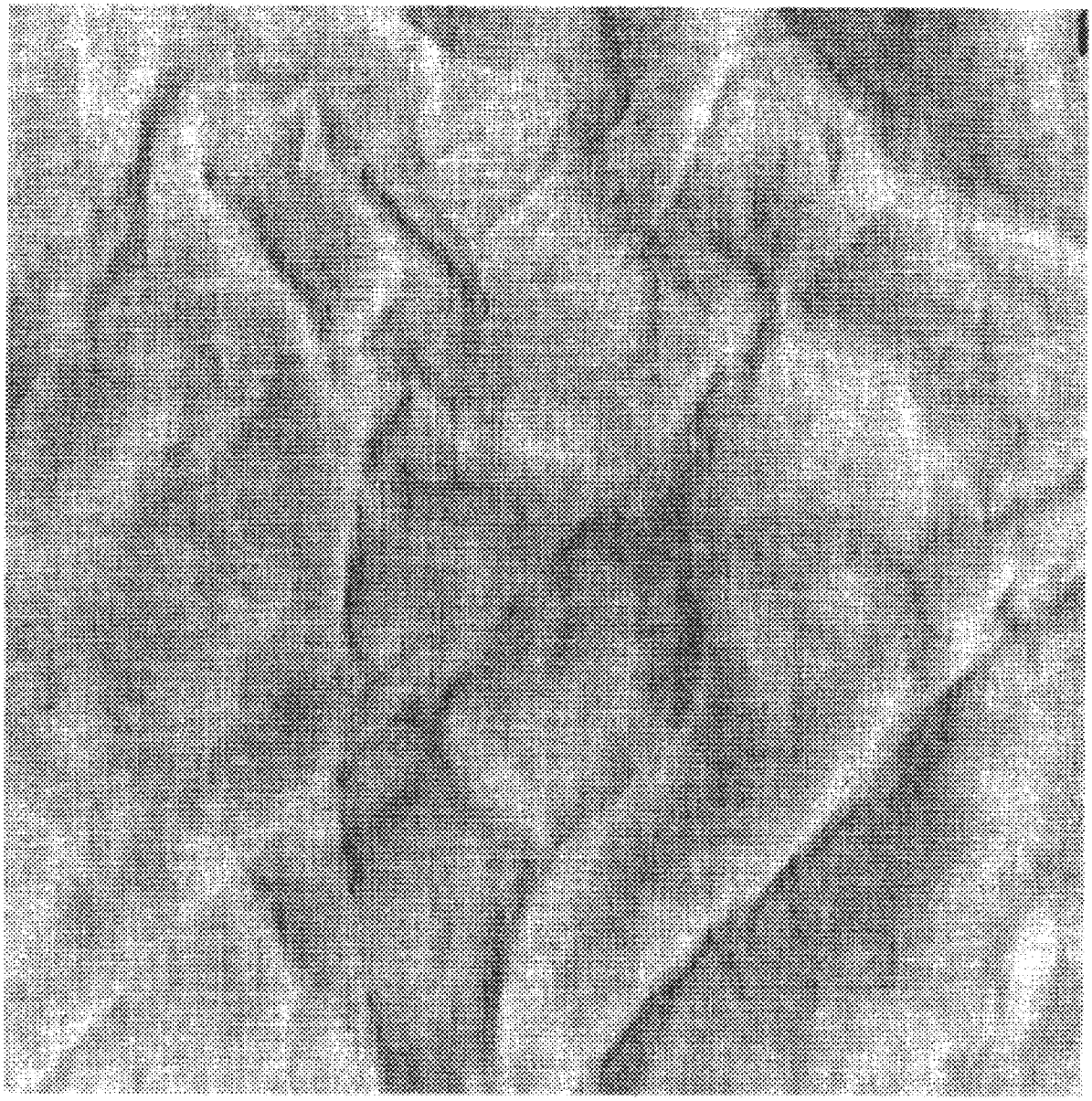
FIG. 4 is a photomicrograph of a white cotton swatch which was not treated with a polysaccharide acetal and washed in a standard washing machine.

Referring to the drawings FIG. 3 is a photomicrograph of a white cotton swatch which was treated with the aqueous solution containing a cationic polysaccharide acetal and washed. FIG. 4 is a photomicrograph of a white cotton swatch (Control) which was not treated with the polysaccharide acetal and washed in a standard washing machine. The figures clearly show that the treated swatch exhibited less wrinkles than the untreated swatch after laundering.

While the invention has been described with particular reference to certain embodiments thereof, it will be understood that changes and modifications may be made by those of ordinary skill in the art within the scope and spirit of the following claims.

What is claimed is:

1. A method for imparting permanent press properties to a textile containing cellulose fibers wherein said method comprises applying an aqueous solution of a polysaccharide aldehyde at a pH of from about 1 to about 8 to a textile, and heating the textile at a sufficient temperature for a sufficient time to react the polysaccharide aldehyde with the textile wherein water is removed from the textile, to impart permanent press properties to the textile, wherein the polysaccharide aldehyde has a structure selected from the group consisting of

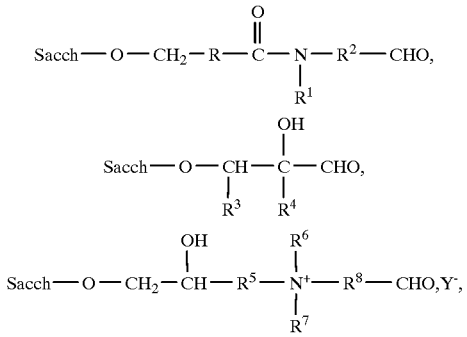

and combinations thereof, wherein Sacch-O is a polysaccharide molecule; R is $(CH_2)_n$ or a divalent aromatic group wherein n is 0 to 22; $R^1$, $R^6$, and $R^7$ are independently selected from the group consisting of hydrogen, and a $C_1$ to $C_{22}$ alkyl, aryl, aralkyl, or alkaryl group; $R^2$, $R^5$ and $R^8$ are independently $(CH_2)_m$ wherein m is 1 to 6; $R^3$ and $R^4$ are independently selected from the group consisting of hydrogen and an alkyl group having 1 to 6 carbon atoms; and Y is an anion.

2. A method for imparting permanent press properties to a textile containing cellulose fibers wherein said method comprises contacting a textile with an aqueous solution comprising a polysaccharide acetal at a pH of from about 1 to about 8, and heating the textile at a sufficient temperature for a sufficient time to hydrolyze the polysaccharide acetal to a polysaccharide aldehyde and to react the polysaccharide aldehyde with the textile wherein water is removed from the textile, to impart permanent press properties to the textile, wherein the polysaccharide acetal has a structure selected from the group consisting of

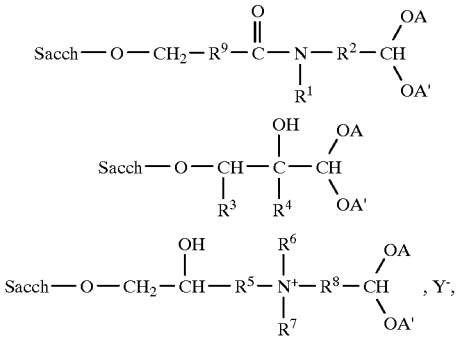

and combinations thereof, wherein Sacch-O is a polysaccharide molecule; R is $(CH_2)_n$ or a divalent aromatic group wherein n is 0 to 22; $R^1$, $R^6$, and $R^7$ are independently selected from the group consisting of hydrogen, and a $C_1$ to $C_{22}$ alkyl, aryl, aralkyl, or alkaryl group; $R^2$, $R^5$ and $R^8$ are independently $(CH_2)_m$ wherein m is 1 to 6; $R^3$ is hydrogen or an alkyl group having 1 to 6 carbon atoms; $R^4$ is selected from the group consisting of hydrogen, and a $C_1$ to $C_{22}$ alkyl, aryl, aralkyl, or alkaryl group; $R^9$ is $(CH_2)_n$ or a divalent aromatic group wherein n is from 0 to about 22; A and A' are independently an alkyl group having 1 to 6 carbon atoms or A and A' together form at least a 5-membered cyclic acetal; and Y is an anion.

3. The method according to claim 1 wherein the polysaccharide aldehyde has at least one cationic substituent group covalently bonded to the polysaccharide.

4. The method according to claim 3 wherein the cationic substituent group is selected from the group consisting of diethylaminoethylether groups, 3-(trimethyl ammonium chloride)-2-hydroxypropyl ether groups, and combinations thereof.

5. The method according to claim 2 wherein the polysaccharide acetal has at least one cationic substituent group covalently bonded to the polysaccharide.

6. The method according to claim 5 wherein the cationic substituent group is selected from the group consisting of diethylaminoethylether groups, 3-(trimethyl ammonium chloride)-2-hydroxypropyl ether groups, and combinations thereof.

7. The method according to claim 1 wherein the cellulosic textiles are selected from the group consisting of cotton, rayon, linen, polyester/cotton, polyester/rayon, and combinations thereof.

8. The method according to claim 7 wherein the textile is cotton.

9. The method according to claim 1 wherein the polysaccharide is selected from the group consisting of starch, gum, cellulose, and combinations thereof.

10. The method according to claim 9 wherein the starch is selected from the group consisting of waxy maize, corn, high amylose corn, potato, rice, sweet potato, tapioca starch, and combinations thereof.

11. The method according to claim 1 wherein $R^1$, $R^6$, and $R^7$ are independently hydrogen or a methyl group; n is from 0 to about 11; m is 0 or 1; and $R^3$ and $R^4$ are hydrogen.

12. The method according to claim 11 wherein n is 1; m is 1; $R^1$ is hydrogen or methyl; and $R^6$ and $R^7$ are methyl.

13. The method according to claim 1 wherein the anion Y is selected from the group consisting of a halide, sulfate, and nitrate.

14. The method according to claim 1 wherein the aqueous solution comprising the polysaccharide aldehyde has a pH of from about 2 to about 6.

15. The method according to claim 14 wherein the aqueous solution comprising the polysaccharide aldehyde has a pH of from about 2 to about 4.

16. The method according to claim 2 wherein the aqueous solution comprising the polysaccharide acetal has a pH of from about 2 to about 6.

17. The method according to claim 16 wherein the aqueous solution comprising the polysaccharide acetal has a pH of from about 2 to about 4.

18. The method according to claim 1 further comprising the step of adding a Lewis acid catalyst either to the aqueous solution of the polysaccharide aldehyde or to the textile.

19. The method according to claim 18 wherein the Lewis acid catalyst is selected from the group consisting of dibutyltindilaurate, iron(III)chloride, scandium(III) trifluoromethanesulfonic acid, boron trifluoride, tin(IV) chloride, aluminum sulfate hydrate, $MgCl_2.6H_2O$, $AlK(SO_4)_2.10H_2O$, $BX_3$, $AlX_3$, $FeX_3$, $GaX_3$, $SbX_3$, $SnX_4$, $AsX_5$, $ZnX_2$, and $HgX_2$, wherein X is a halogen atom or an inorganic radical.

20. The method according to claim 19 wherein the Lewis acid catalyst is selected from the group consisting of aluminum sulfate hydrate, $MgCl_2.6H_2O$, and $AlK(SO_4)_2.10H_2O$.

21. The method according to claim 1 wherein the concentration of the polysaccharide aldehyde in the aqueous solution is sufficient to provide from about 0.1 to about 10 weight percent of polysaccharide aldehyde in the textile based on the oven-dry weight of the textile.

22. The method according to claim 21 wherein the concentration of the polysaccharide aldehyde in the aqueous solution is sufficient to provide from about 1 to about 5 weight percent of polysaccharide aldehyde in the textile based on the oven-dry weight of the textile.

23. The method according to claim 1 wherein the polysaccharide aldehyde is added to rinse water of a laundering process.

24. The method according to claim 1 further comprising the step of adding a Lewis acid catalyst to the aqueous solution of the polysaccharide.

25. The method according to claim 2 further comprising the step of adding a Lewis acid catalyst to the aqueous solution of the polysaccharide acetal.

26. The method according to claim 25 wherein the Lewis acid catalyst is added to rinse water of a laundering process.

27. The method according to claim 1 wherein the polysaccharide aldehyde is sprayed onto the textile.

28. The method according to claim 2 wherein the polysaccharide acetal is sprayed onto the textile.

29. A textile containing cellulose fibers treated by the method according to claim 1.

30. A textile containing cellulose fibers treated by the method according to claim 2.

* * * * *